US005577996A

United States Patent [19]

Gardner et al.

[11] Patent Number: 5,577,996

[45] Date of Patent: Nov. 26, 1996

[54] BACK MASSAGER

[76] Inventors: Gary R. Gardner, Rte. 1, Box 206, West, Tex. 76691; James N. Kontaratos, 1737 E. Frankfurt #2602, Carrollton, Tex. 75007

[21] Appl. No.: 404,640

[22] Filed: Mar. 15, 1995

[51] Int. Cl.[6] ..... A61H 15/00

[52] U.S. Cl. ..... 601/120; 601/118; 601/129

[58] Field of Search ..... 601/120, 118, 601/119, 121, 122, 128, 129

[56] References Cited

U.S. PATENT DOCUMENTS

| | | | |
|---|---|---|---|
| 2,221,785 | 11/1940 | Douglas | 601/120 |
| 2,286,324 | 6/1942 | Wentz | 601/120 |
| 3,616,794 | 11/1971 | Gromala | 601/120 |
| 4,433,683 | 2/1984 | McCoy | 601/120 |
| 4,936,294 | 6/1990 | Chu | 601/136 |
| 5,364,338 | 11/1994 | Terashima | 601/120 |

FOREIGN PATENT DOCUMENTS

| | | | |
|---|---|---|---|
| 1534013 | 11/1978 | United Kingdom | 601/120 |

*Primary Examiner*—Robert A. Hafer
*Assistant Examiner*—Benjamin K. Koo
*Attorney, Agent, or Firm*—Robert C. Curfiss; Butler & Binion, L.L.P.

[57] ABSTRACT

A hand held massage device having a plurality of spheres adjustably mounted on an axial rod with enlarged grip handles mounted on the outer ends of the rod for rotation. The massage device is easy to use and, because the handles are in axial alignment with the massage spheres, allows the user to apply and direct the desired amount of pressure. The spheres of the massage device may be adjusted to various positions along the axis of the rod to comfort and to direct the massage to specific areas.

7 Claims, 1 Drawing Sheet

BACK MASSAGER

BACKGROUND OF INVENTION

1. Field of Invention

The subject invention is generally related to massage devices and is specifically directed to a hand held massage device having a plurality of spherical rollers adjustably mounted on a rod with enlarged grip handles.

2. Description of the Prior Art

Hand held massage devices in which a rolling member is applied to a part of a person's body to massage the area are well known. Some examples of these prior art devices are shown in U.S. Pat. Nos. D259,142; 2,246,263; 2,286,324; and 4,989,585. U.S. Pat. Nos. D259,142, 2,246,263 and 4,989,585 (first embodiment) all show T-shaped massage devices having a rolling member mounted on a shaft at one end of the device and a long handle portion extending perpendicularly from the shaft of the rolling member. While the long perpendicular handle allows an individual to perform a self back massage, having a handle which is not in line with the shaft axis may make it difficult to maneuver the device. For example, it may be difficult to apply even pressure over the body area covered and may not allow suitable or desired pressure to be applied to certain specific areas. Moreover, the position of the rolling member on the device is not adjustable as may be needed for massaging specific areas and the comfort of different users of the device.

U.S. Pat. Nos. 2,286,324 and 4,989,585 (second embodiment) each disclose a massage roller having rod with a rolling member in the middle and handles on the outer ends for gripping the roller. The rolling member is a pair of abutting spheres fixed in position on the rod. In U.S. Pat. No. 2,286,324, the handles of the massage roller are adjustable to selectively engage the permanently positioned rotatable spheres for causing the rotatable spheres to drag. While the handles may be moved inward along the rod to engage the spheres, the spheres are not adjustable along the rod.

Therefore, there is a need for a simple hand held massage device including massage rollers of a desired firmness which allows suitable or desired pressure to be applied to specific areas and is designed to allow the position of the rollers to be adjusted along the axis of the shaft for pinpoint massaging and comfort.

SUMMARY OF THE INVENTION

The subject invention is directed to a hand held massage device having a plurality of spheres adjustably mounted on an axial rod with enlarged grip handles on the outer ends of the rod. The massage device is easy to maneuver and is designed to allow the user to apply the desired amount of pressure to specific areas. The massage device of the subject invention is specifically designed to include spheres which may be adjusted along the axis of the rod to comfort and so that the operator may direct the desired amount of pressure to specific areas.

In the preferred embodiment, the massage device is a dowel or the like defining a shaft having opposite outer ends and a middle section. A pair of hollow, resilient spheres, such as tennis balls, are mounted on the middle section of the shaft. Because the hole through each ball is slightly smaller than the circumference of the shaft, the balls remain in place and rotate in conjunction with the shaft. The balls are movable in or out along the shaft as needed by applying sufficient axial force to slide them along the shaft axis.

In the preferred embodiment, tennis balls are used because it has been found that the firm yet slightly resilient nature of such balls is extremely well suited to the subject invention. For example, a device using wooden rollers may be too hard and cause discomfort when pressure is applied and it is rolled across the massaged area. Alternatively, if the balls are too soft, the user may not be able to achieve the desired amount of pressure and the massage is ineffectual.

The preferred embodiment includes an enlarged sleeve fixed on each outer end of the shaft to define the grip handles of the device. The sleeves are slightly larger than the shaft so that the shaft rotates within the sleeves. To use the back massager, the operator grips the handles and rolls the balls in a forward and backward motion along the desired part of a person's body. As needed to massage specific areas, the balls may be axially adjusted along the shaft to various positions along the shaft.

It has been found that the massage device of the subject invention is particularly well suited for therapeutic massaging because of the amount of pressure that can be applied and the ability to specifically direct the pressure to desired areas. In addition, the device is easy to maneuver and inexpensive to manufacture.

Therefore, it is an object and feature of the subject invention to provide an inexpensive hand held massage device having a plurality of spheres mounted on an axial shaft or rod with outer ends including enlarged grip handles rotatably mounted on the shaft for rolling the spheres in a forward and backward motion along the desired part of a person's body.

It is another object and feature of the subject invention to provide a hand held massage device having spheres which are adjustably positioned along the axis of the rod.

It is a further object and feature of the subject invention to provide a hand held massage device having handles which are in line with the rod axis for allowing the user to apply and direct the desired amount of pressure to specific areas.

Other objects and features will be readily apparent from the accompanying drawings and description.

DETAILED DESCRIPTION OF THE DRAWINGS

Figure 1:
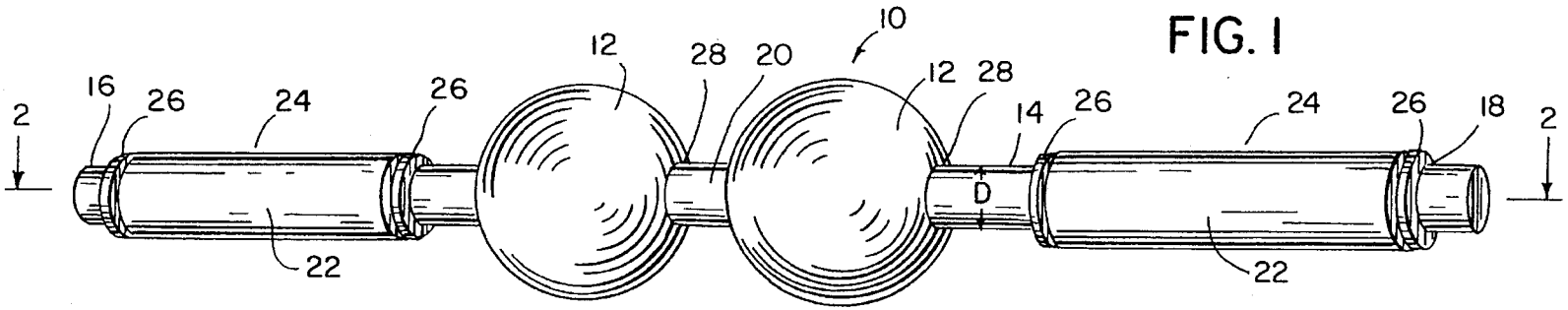
FIG. 1 is a perspective view of the hand held massage device including spheres adjustably mounted on an axial rod with enlarged grip handles.
Figure 2:
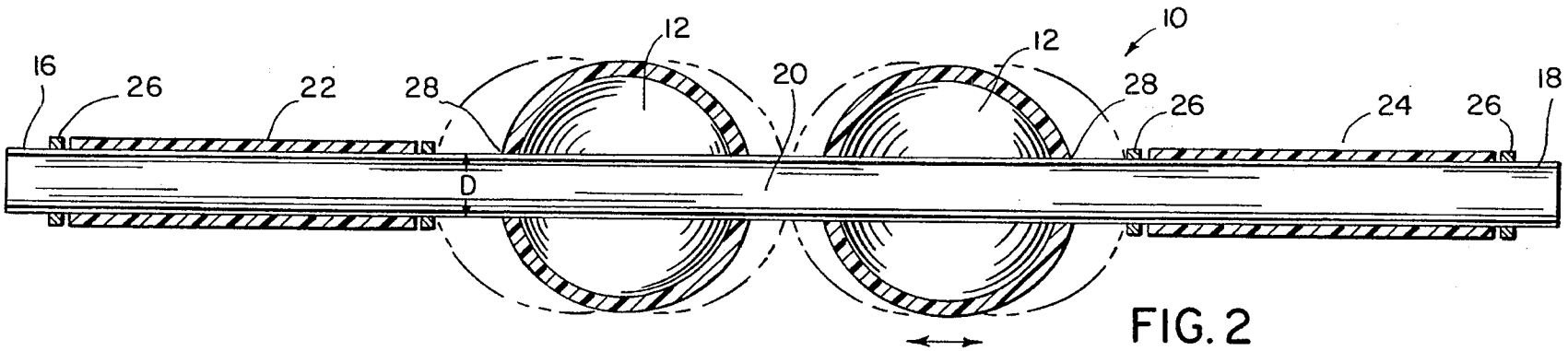
FIG. 2 is cross-sectional view taken along line 2—2 in FIG. 1 showing the hollow spheres mounted on the rod and sleeves rotatably mounted on the rod to form the grip handles with retaining rings on either side each sleeve.

Referring to FIGS. 1 and 2, the massage device 10 of the subject invention is generally comprised of a plurality of spheres 12 adjustably mounted on an axial shaft or rod 14. The rod 14, such as a dowel, has opposite outer ends 16 and 18 and a middle section 20. The hole 28 through each ball has a diameter which is slightly smaller than the diameter D of the shaft to create a snug-fit between the spheres 12 and the rod 14. The snug-fit prevents the spheres 12 from rotating about the rod 14 and secures them in place once they are positioned on the rod.

As shown in FIGS. 1 and 2, an enlarged outer sleeve 22 is positioned around the rod 14 near each outer end 16 and 18 to define enlarged handles 24 for gripping the massage device 10. The enlarged sleeves 22 are axially secured in place near the outer ends 16 and 18 by retaining rings 26 positioned on the rod 14 on either side of each sleeve 22. In the preferred embodiment, the sleeves 22 are slightly larger than the rod 14 so that the sleeves 22 rotate about the rod when the massage device is used. In the preferred embodiment, the sleeves 22 do not include a resilient cover. However, the sleeves 22 may include a resilient cover to provide handles 24 with a comfortable gripping surface for the user.

In the preferred embodiment, the massage device 10 includes a pair of hollow, resilient spheres 12, such as tennis balls, adjustably mounted on the rod 14. The spheres 12 are tennis balls because it has been found that the firm yet slightly resilient nature of such balls is extremely well suited to the subject invention. As shown in phantom in FIG. 2, the spheres 12 are axially movable along the middle section 20 of the rod 14 between the enlarged handles 24. One or both of the spheres 12 may be slidably adjusted along the axis of the rod 14 as desired for comfort or massaging a specific area.

To use the massage device 10, the operator grips the enlarged handles 24 on each outer end 16 and 18 of the rod 14 and rolls the spheres 12 in a forward and backward motion along the desired part of a person's body. The handles remain stationary in the operator's hands while the rod and spheres rotate together along the massaged area. Because the gripping handles 24 are in axial alignment with the spheres 12, the user may easily maneuver the device and apply the desired amount of pressure as needed for an effective massage. In addition, the spheres 12 may be adjusted along the axis of the rod 14 to various positions as needed for comfort and to directly massage specific areas.

While specific embodiments and features of the invention have been disclosed herein, it will be readily understood that the invention encompasses all enhancements and modifications within the scope and spirit of the following claims.

What is claimed is:

1. A hand held massage device comprising:

a. a rod having a central axis, an outer diameter, opposite outer ends and a middle section;

b. a plurality of resilient spheres adjustably mounted on the middle section of the rod, each sphere having a center, a hole through the center and said rod extending through the hole in each sphere, said hole having a diameter slightly smaller than the outer diameter of the rod to create a snug-fit between the spheres and the rod, wherein said spheres are non-rotatable about the rod;

c. wherein each sphere is axially movable and positionable along the middle section of the rod; and d. a sleeve rotatably mounted in an axially fixed position on each outer end of the rod, said sleeves defining enlarged handles for gripping the rod and rolling the device across a part of a person's body.

2. The hand held massage device of claim 1, further including a plurality of retaining rings positioned on the rod for securing each sleeve in position at the outer ends of the rod.

3. The hand held massage device of claim 2, the sleeves having a resilient cover.

4. The hand held massage device of claim 2, wherein the spheres are hollow.

5. The hand held massage device of claim 4, wherein the spheres are standard tennis balls.

6. The hand held massage device of claim 1, wherein said plurality of spheres comprises two spheres mounted on the rod.

7. The hand held massage device of claim 2, wherein at least one sleeve is removable for removing and replacing the spheres.

* * * * *